US005645214A

United States Patent [19]

Taganas

[11] Patent Number: 5,645,214

[45] Date of Patent: Jul. 8, 1997

[54] COMBINATION ENVELOPE AND GREETING CARD

[76] Inventor: Celina M. Taganas, P.O. Box 3023, Pismo Beach, Calif. 93448

[21] Appl. No.: 537,452

[22] Filed: Oct. 2, 1995

[51] Int. Cl.[6] ..... B65D 27/34

[52] U.S. Cl. ..... 229/313; 229/92.7; 229/92.8

[58] Field of Search ..... 229/300, 305, 229/92.1, 92.8, 313, 316, 92.7

[56] References Cited

U.S. PATENT DOCUMENTS

| | | | |
|---|---|---|---|
| 228,522 | 6/1880 | Fletcher | 229/92.7 |
| 3,223,312 | 12/1965 | Caine | 229/92.8 |
| 3,303,987 | 2/1967 | Caine | 229/92.8 |
| 3,711,012 | 1/1973 | Cytron et al. | 229/92.7 |
| 5,135,157 | 8/1992 | Cruz | 229/92.8 |

FOREIGN PATENT DOCUMENTS

| | | | |
|---|---|---|---|
| 627873 | 10/1927 | France | 229/92.7 |
| 9810 | of 1901 | United Kingdom | 229/92.7 |
| 28709 | of 1908 | United Kingdom | 229/92.7 |

*Primary Examiner*—Jes F. Pascua

*Attorney, Agent, or Firm*—Gene Scott - Patent Law & Venture Group

[57] ABSTRACT

A combination envelope and greeting card having a primary panel with ancillary top, bottom and side panels foldably attached to it in a way that allows the ancillary panels to be torn away from the primary panel as desired. Permanent and releasable adhesive are all strategically located on the panels so that when the panels are folded over the primary panel and adhered to one another in a designated order, the combination becomes a compact, securely sealed unit that can be mailed. In the folded over configuration, panel surfaces containing greeting introduction indicia or a greeting message are not exposed, while a panel surface that contains address and postage aligning indicia faces outwardly.

1 Claim, 6 Drawing Sheets

COMBINATION ENVELOPE AND GREETING CARD

BACKGROUND OF THE INVENTION

1. Field of the Invention

This invention relates generally to greeting cards and more particularly to an improved combination and greeting card.

2. Description of Related Art

Invention and use of both greeting cards and envelopes are well known to the public. Typically, whenever it is desired to send a greeting card through the mail, the card must be put in a separate envelope. Since cards are manufactured in a wide variety of different shapes and sizes, special greeting-card envelopes are generally displayed next to the greeting cards themselves, and the price of the envelope is included in the overall cost of the card.

Unfortunately, there are several problems with this standard greeting card system. First of all, due to the wide variety of different card shapes and sizes, it is often difficult for a user to immediately locate an appropriately sized envelope. Still further, since the envelopes and cards do not come as a single unit, the available envelopes often does not match the color or the theme of the greeting card itself.

Yet another problem with the standard greeting card and envelope configuration is that it generates unnecessary waste, as the envelope serves only to provide a protective covering for the card and provide a surface upon which to place postage and address information and does not in any way enhance or correlate to the enclosed card. Once the envelope is opened and the card removed, it is generally discarded.

Unfortunately, the construction of standard greeting cards is such that an envelope is essential. Although most cards are constructed of a card stock thick enough to withstand postal processing, this is generally unfeasible, as there is no means by which to securely seal a card by itself and there is no way to effectively protect the cover of the card from being defaced in the mail.

To remedy these problems, Cruz U.S. Pat. No. 5,135,157 discloses a combined envelope and greeting card which consists of a greeting card configuration having two panels and a mechanism for sealing the greeting card configuration so that it is transformed into an envelope configuration. The device also includes a mechanism for breaking the sealing mechanism so that the envelope configuration can be transformed back into the greeting card configuration once it has been sent through the mail.

Unfortunately, this device is plagued by numerous problematic and, as such, has not gained widespread popularity. First of all, Cruz' device consists of only two main panels. When the panels are folded into the envelope configuration, one outfacing panel has indicia for addressing the envelope and properly applying postage, while the other outfacing panel serves as the front cover of the card which contains the greeting introduction of the card, such as a picture, poem or the like. This is undesirable, as these surfaces are likely to be soiled, bent or damaged during mailing, thus detracting from the greeting introduction of the card. Still further, this design is undesirable in that it does not allow money, photographs or any other such enclosure to be safely sent with the card.

Thus, there is a clear need for an improved card and envelope combination constructed so that when it is folded into an envelope configuration, the greeting card indicia does not face outwardly. Such a combination would also be constructed so as to allow enclosures to be safely sent with the card.

The present invention fulfills these needs and provides further related advantages as described in the following summary.

SUMMARY OF THE INVENTION

The present invention is an improved card and envelope combination designed to allow a single greeting card to be sent through the mail without requiring a separate envelope. The combination has a rectangular main panel with a top, bottom and two side panels integrally attached to and extending outwardly from each of the four edges of the main panel. These panels are constructed so that they are easily foldable over the main panel. In use, the combination is similar to a standard greeting card in that, when folded over the main panel, the top panel provides a front card cover with an introductory poem, picture, phrase or the like. When the top panel is lifted away from the main panel, thus "opening" the card, the main panel provides either a preprinted message or a blank surface to allow the card to be customized for any occasion. In use the combination is also similar to a standard envelope in that when the bottom and side panels are properly folded over the card portion, the panels completely cover and protect the card portion of the device in a compact, sealed fashion. Thus, it is a primary object of the present invention to provide a combination card and envelope combination that enables a single unit to be utilized as both a greeting card and an envelope. This combination is significantly less expensive to manufacture than separate cards and envelopes, and it also results in less paper waste.

Still further, such a combination effectively prevents the mismatching of card and envelope sizes, colors, styles, etc.

Adhesive is strategically placed on the bottom and side panels so that when the panels are folded over the top and main panels in a prescribed order, they are adhesively secured in a compact, sealed, folded-over configuration. Thus it is an object of the present invention to provide a envelope and card combination that can be sealed in a folded configuration, thus allowing items such as pictures, money, letters, etc. to be safely enclosed within the device and mailed while providing an outfacing surface on which to place postage and address information.

This configuration is a significant advantage over the prior art, as the prior art device provides only two panels and therefore includes no way by which to completely seal the device in the folded configuration. The use of only two panels is also undesirable, as it forces one of the greeting card surfaces to face outwardly. The present invention improves greatly over this configuration by incorporating a five panel device in which neither the front cover of the greeting card nor the inner panels of the card are exposed when the device is in the folded-over configuration, thus ensuring that the card surfaces of the device are not soiled, bent or otherwise damaged during the mailing process.

It is yet another object of the present invention to attach the ancillary panels to the main panel in such a way that the panels may be tom away from the main panel as desired. This is a significant advantage in that it allows the extra panels of the device to be removed so that the card can be easily displayed or stored.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a combination envelope and card. In such drawings.

DETAILED DESCRIPTION OF THE PREFERRED EMBODIMENT

Figure 1:
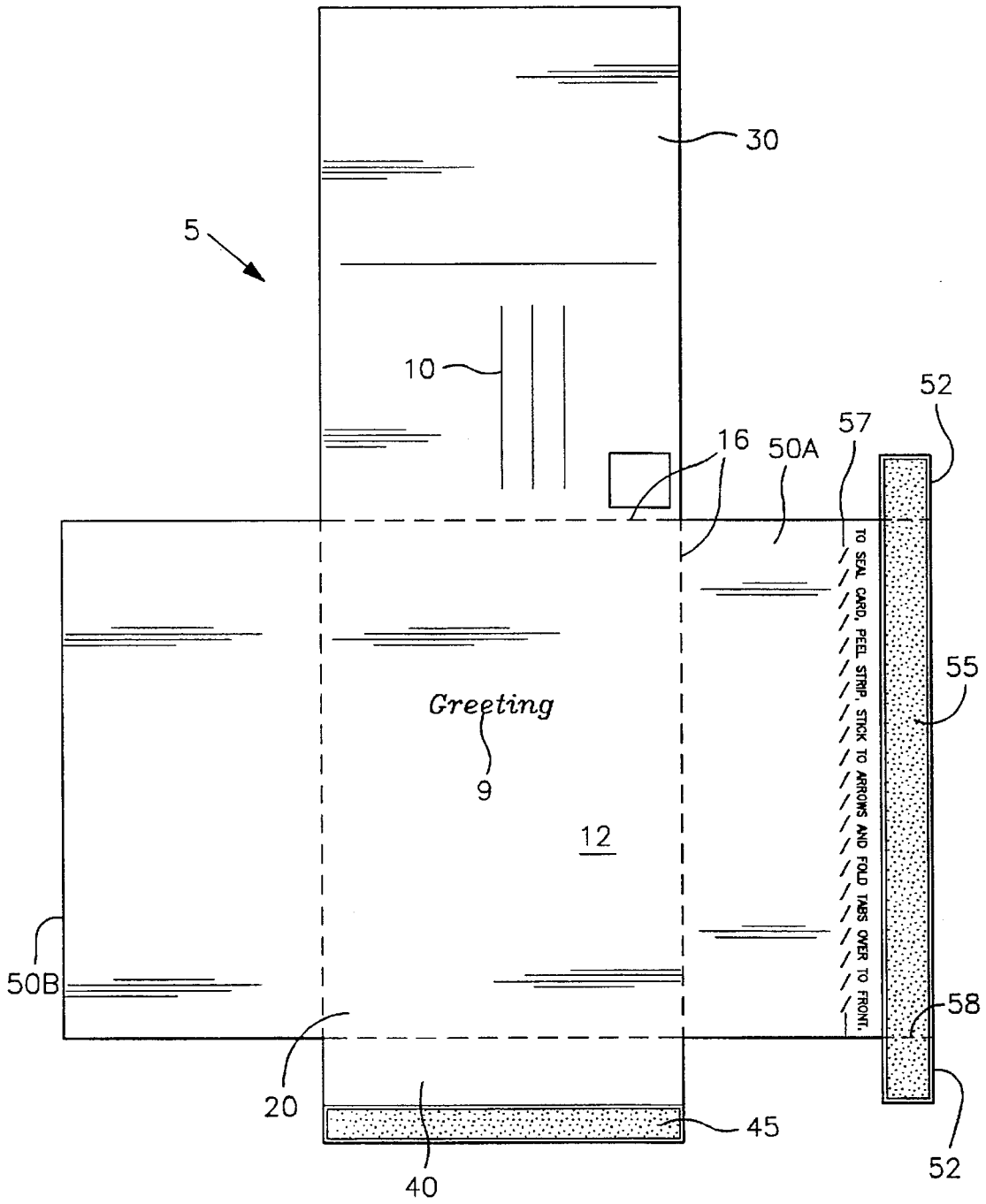
FIG. 1 is a plan view of a first preferred embodiment of the present invention, particularly showing an obverse surface of the invention.

The above described drawing figures illustrate an envelope and greeting card combination 5. The envelope and card combination 5 is constructed of a single piece of flat sheet material, preferably a high-quality paper stock, cardboard or other similar paper product. The sheet material is cut, in the flat, so as to form a primary panel 20 that has a contiguous top 30, bottom 40 and a pair of side ancillary panels 50, foldably joined to it. Preferably the ancillary panels are each attached to the primary panel 20 by a means for separation 16 so that they may be tom from the primary panel 20 if desired. Preferably, the separation means 16 consists of a score line or a partially perforated line i.e., a series of, more-or-less elongated, relatively small, perforations in the flat sheet material, wherein the perforations are arranged linearly, the perforations being separated by portions of the flat sheet material which are not perforated, as clearly shown by designation numeral 16 in FIGS. 1 and 3, although the invention is by no means limited to such embodiments as separation means are notoriously well known in the art.

As illustrated in the figures, the primary panel 20 preferably has a generally rectangular shape, although it is by no means limited to this configuration. In one preferred embodiment, illustrated in FIGS. 1–4, the top panel 30 has a height approximately equal to that of the primary panel 20, while the bottom panel 40 preferably has a height that is significantly less than that of the primary panel 20. While the illustrated height of the top 30 and bottom 40 panels is preferable, the invention is in no way limited to such dimensions, as the panels may ultimately be constructed with any selected height that is less than that of the primary panel 20. The width of the side panels 50 is likewise a matter of choice, provided that neither panel has a width greater than that of the primary panel 20. It is also essential that the combined width of the two side panels 50 is greater than the width of the primary panel 20 so that the side panels at least slightly overlap one another when they are folded over the primary panel 20.

Figure 2:
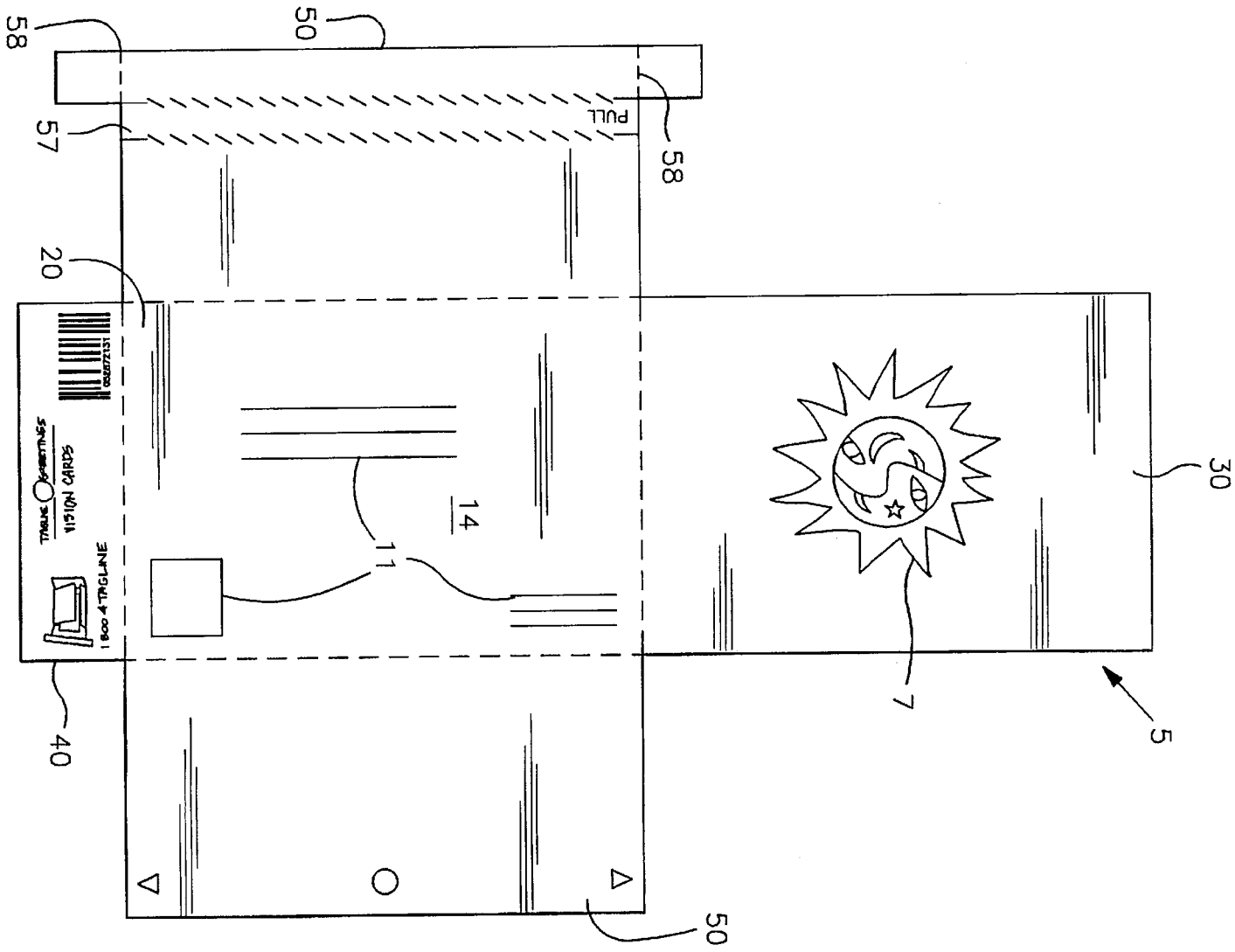
FIG. 2 shows the reverse surface thereof.

FIG. 1 shows an obverse surface 12 of the card and envelope combination 5, while FIG. 2 shows a reverse surface 14 of the combination, both of which are shown layed-out in the flat.

A pre-printed greeting message 9 is preferably printed on the obverse surface 12 of the primary panel 20, although the obverse surface 12 of the primary panel 20 may also be blank (not shown), thus allowing the card to be personally customized for a variety of occasions. Preferably, printed post card indicia 10 is positioned on the obverse surface 12 of the top ancillary panel 30 so that the top panel 30 may be detached from the primary panel 20 and used as a post card. The obverse surface 12 of the bottom panel 40 has a releasable adhesive layer 45, such as the type of adhesive used for post-it notes and such. The adhesive layer 45 preferably extends across the width of the panel 40, as illustrated in FIG. 1, although it may also consist of several smaller adhesive layers distributed across the bottom panel's obverse surface 12.

As clearly seen in FIG. 1, a pair of laterally extending tabs 52 extend from a top and bottom edge of a first side panel 50A. A permanent adhesive layer 55 is provided on the obverse surface 12 of this side panel 50A. The adhesive layer 55 may be either an active or a non-active adhesive. When an active adhesive layer 55 is implemented, a sheet of non-stick material covers the adhesive layer 55 so that the sheet can be simply peeled away to expose the active adhesive layer 55. A non-active adhesive layer 55, preferably of the type activated by contact with water, alcohol or the like, may alternately be implemented. The first side panel 50A also includes a panel tearing means 57. As with the means for separation 16, the panel tearing means 57 may consist of a score line or partially perforated line, although the invention is not limited to such embodiments. In one preferred embodiment, best seen in FIG. 2, the panel tearing means 57 consists of two parallel, spaced apart lines of perforation. Additionally, as seen in FIG. 1, a tab tearing means 58, such as a perforated or scored line, is provided along each tab 52 so that they may be easily tom away from the side panel 50. The adhesive layer 55 preferably spans the length of the side panel 50A and covers both tabs 52, as seen in FIG. 1. In this embodiment, the tab tearing means 58 also preferably extends through the adhesive layer 55, thus making it easier to fold over and tear away the tabs 52. Alternately, the adhesive layer 55 may consist of smaller adhesive layers distributed across the side panel's obverse surface 12, as long as adhesive is provided on each tab 52.

As seen in FIG. 2, the reverse surface 14 of the primary panel 20 is designed to receive postage and address information, and therefore preferably provides indicia 11 for properly aligning postage, a mailing address and a return address. Alternately, the primary panel's reverse surface 14 may be blank (not shown) so as to allow custom labels, enlarged print, varying sized postage, etc. to be more neatly applied. The reverse surface 14 of the top ancillary panel 30 is designed to contain greeting introduction indicia 7, such as a cartoon, poem or picture.

Figure 3:
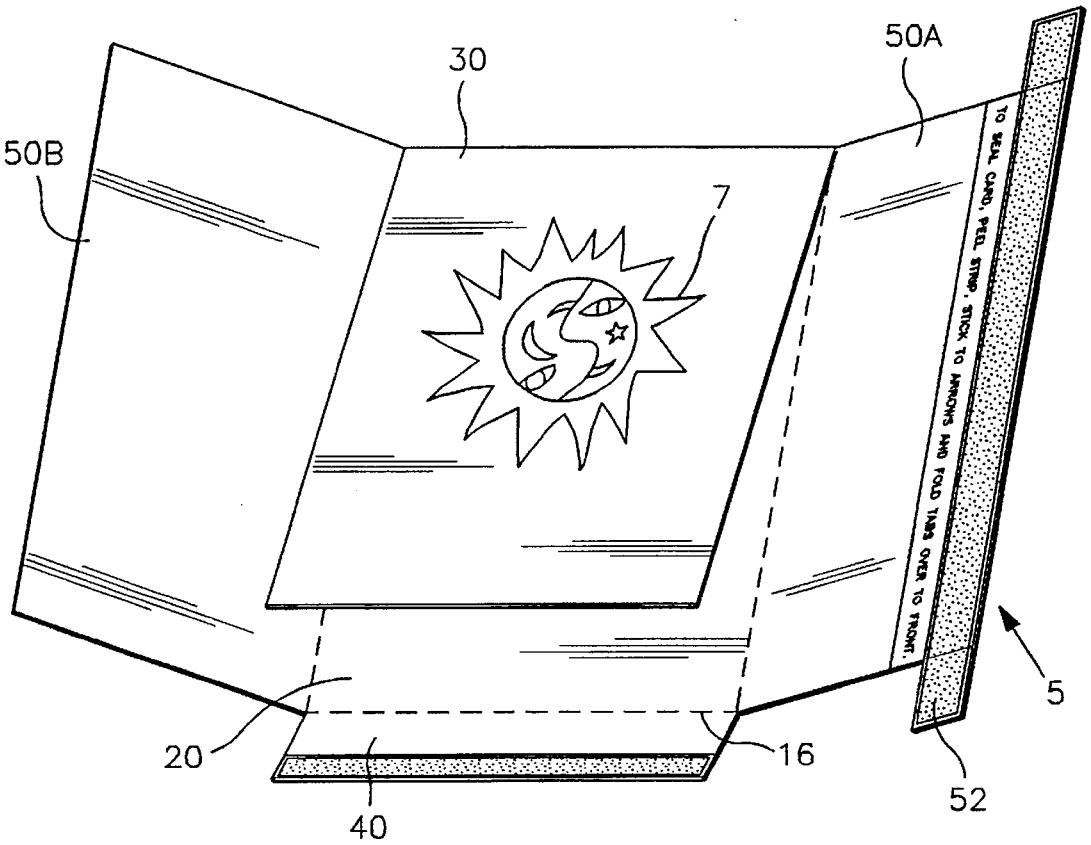
FIG. 3 show a partial folding thereof.
Figure 4:
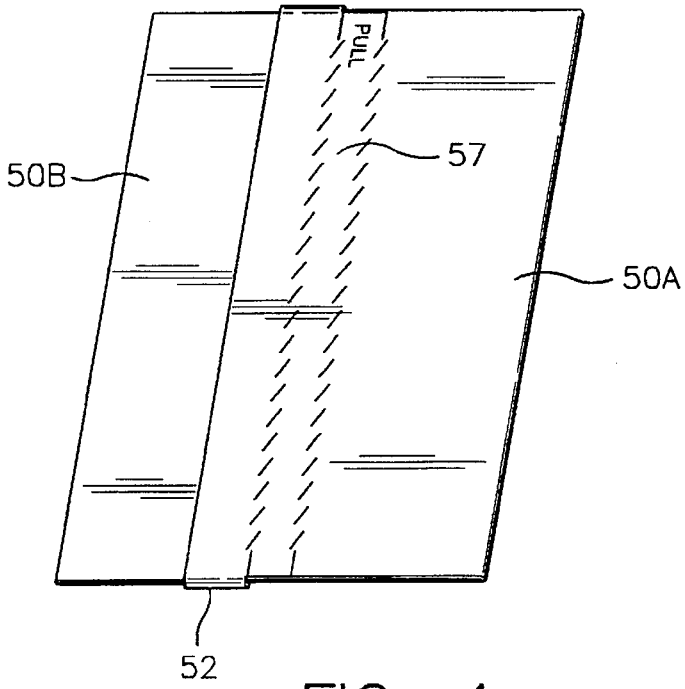
FIG. 4 shows a completed folding thereof.
Figure 5:
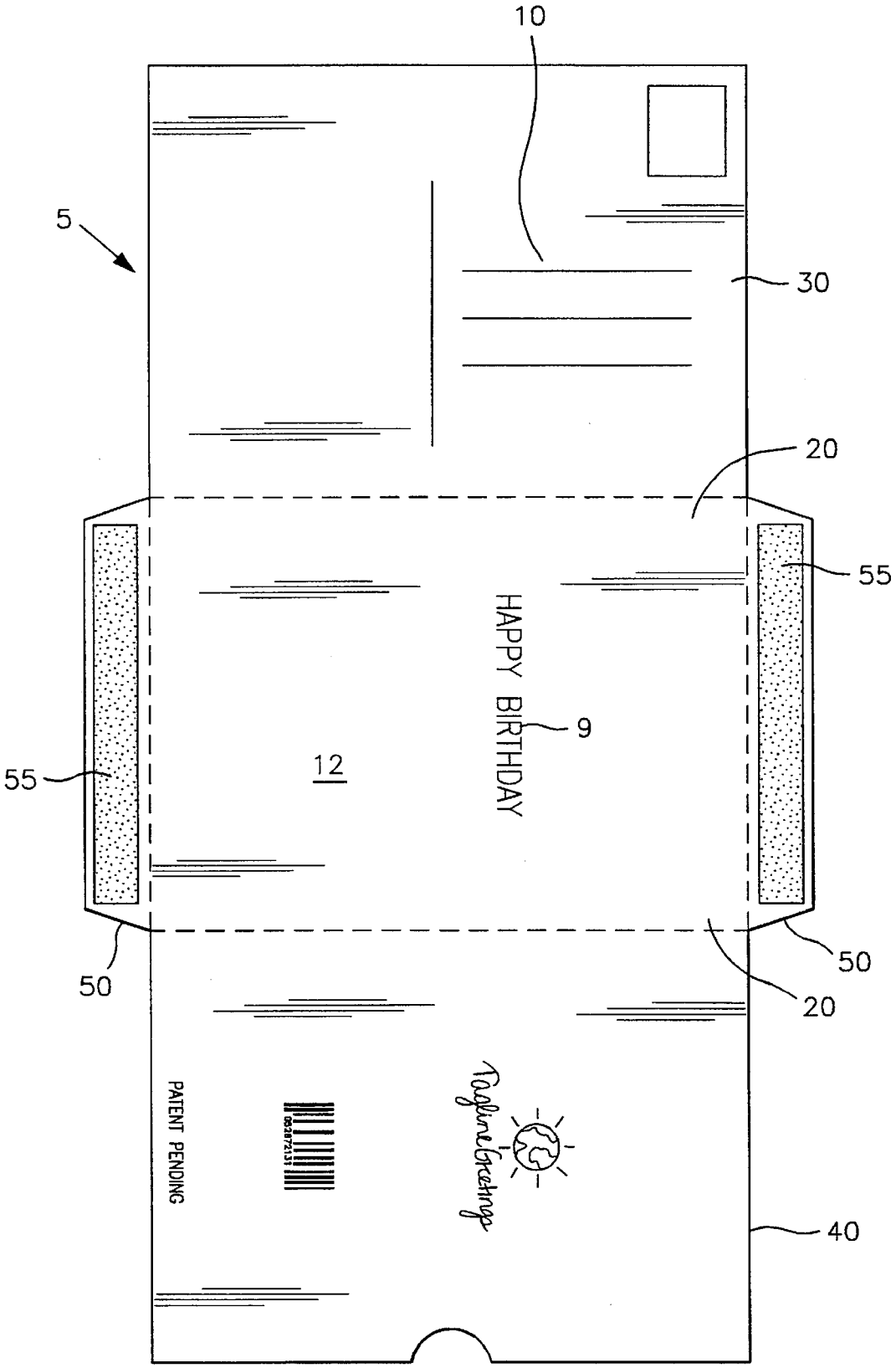
FIG. 5 is a plan view of a second preferred embodiment of the present invention, particularly showing an obverse surface of the invention.
Figure 6:
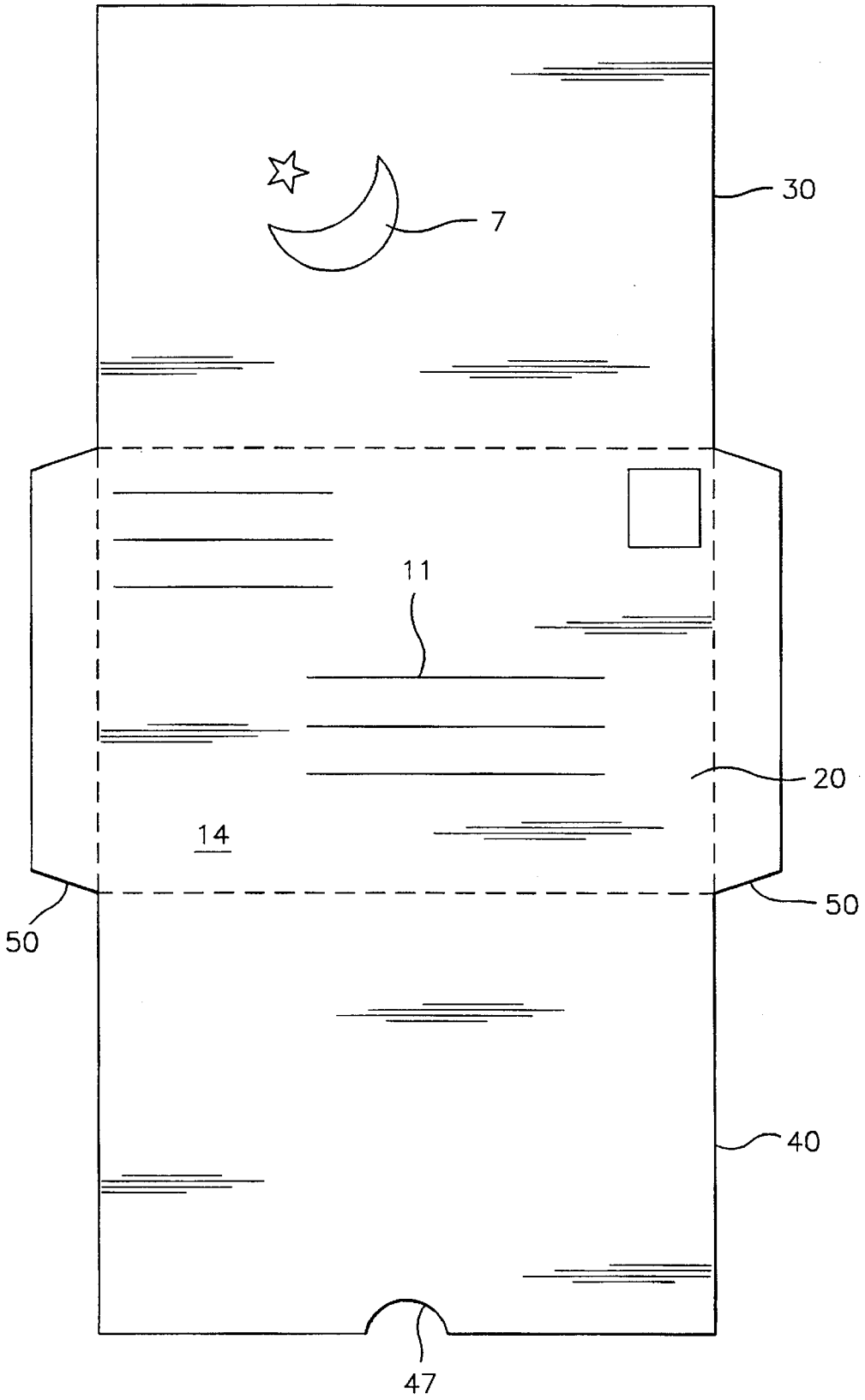
FIG. 6 shows the reverse of FIG. 5.

Thus, to fold the above detailed embodiment of the envelope and greeting card combination 5 into a tightly sealed unit ready for mailing, the top panel 30 is first folded downwardly over the primary panel 20, as illustrated in FIG. 3. The bottom panel 40 is then folded upwardly over the top panel 30 so that the adhesive layer 45 on the obverse side 12 of the bottom panel 40 is releasably engaged with the reverse surface 14 of the top panel 30. Next, the second side panel 50B is folded over the top panel 30. The adhesive layer 55 on the first side panel 50A is exposed or activated, and the first side panel 50A is then folded over and adhered to the second side panel 50B. The tabs 52 are folded around the second side panel 50B and adhered to the reverse surface 14 of the primary panel 20. In this folded configuration, illustrated in FIG. 4, the reverse surface 14 of the primary panel 20 faces outwardly so that postage and addresses may be applied in accordance with the provided printed indicia 11. In the folded configuration all items enclosed within the combination are fully enclosed so as to be held enclosed, and the envelope and card combination 5 is ready to be mailed.

To open the sealed combination secured in the folded configuration, the panel tearing means 57 is pulled until the first side panel 50A is tom completely in half, thus releasing one half of the panel while the tabs of the other portion of the panel remain adhered to the reverse side 14 of the primary panel 20. To release the remaining portion of first side panel 50A and the second side panel 50B, the second side panel 50B is simply pulled upwardly away from the primary panel 20 until the tabs are tom away from the remaining portion of the first side panel 50A along the tab tearing means 58. To ensure that this method works effectively, the strength of the adhesive layer 55 on the tabs 52 must be great enough that the adhesive layer 55 does not yield before the tab tearing means 58 does. Once the greeting card has been read, the bottom 40 and side 50 panels may be removed and discarded, thus creating a greeting card that can be easily displayed or stored. Alternately, the top panel 20 may be removed and utilized as a post card when post card indicia 10 is provided on the obverse surface 12 of the top panel.

In an alternate embodiment of the envelope and card combination 5, illustrated in FIGS. 5–8, the top 30 and bottom 40 panels both preferably have a height approximately equal to that of the primary panel 20, while the side panels 50 preferably have a width that is significantly less than that of the primary panel 20.

As with the above described embodiment, on the obverse surface 12 of the envelope and card combination 5 (FIG. 5), the primary panel 20 preferably contains the greeting message 9, the top panel 30 preferably includes post card indicia 10 and the bottom panel 40 preferably includes the releasable adhesive layer 45 (not shown), although the adhesive layer 45 is optional in this embodiment. Unlike the above embodiment, however, a permanent adhesive layer 55 is positioned on both of the side panels 50.

On the reverse surface 14 of the envelope and card combination 5, greeting introduction indicia 7 is positioned on the top panel 30 and indicia 11 for aligning postage and addresses is preferably positioned on the primary panel 20.

The bottom ancillary panel 40 preferably includes a gripping means 47 for allowing the edge of the panel to be easily grasped. There are numerous embodiments of the gripping means 47 that may be successfully implemented within the scope of the present invention. In one preferred embodiment, illustrated in FIGS. 5 and 6, the gripping means 47 consists of a cut-out sized for acceptance of a user's thumb or finger.

Figure 7:
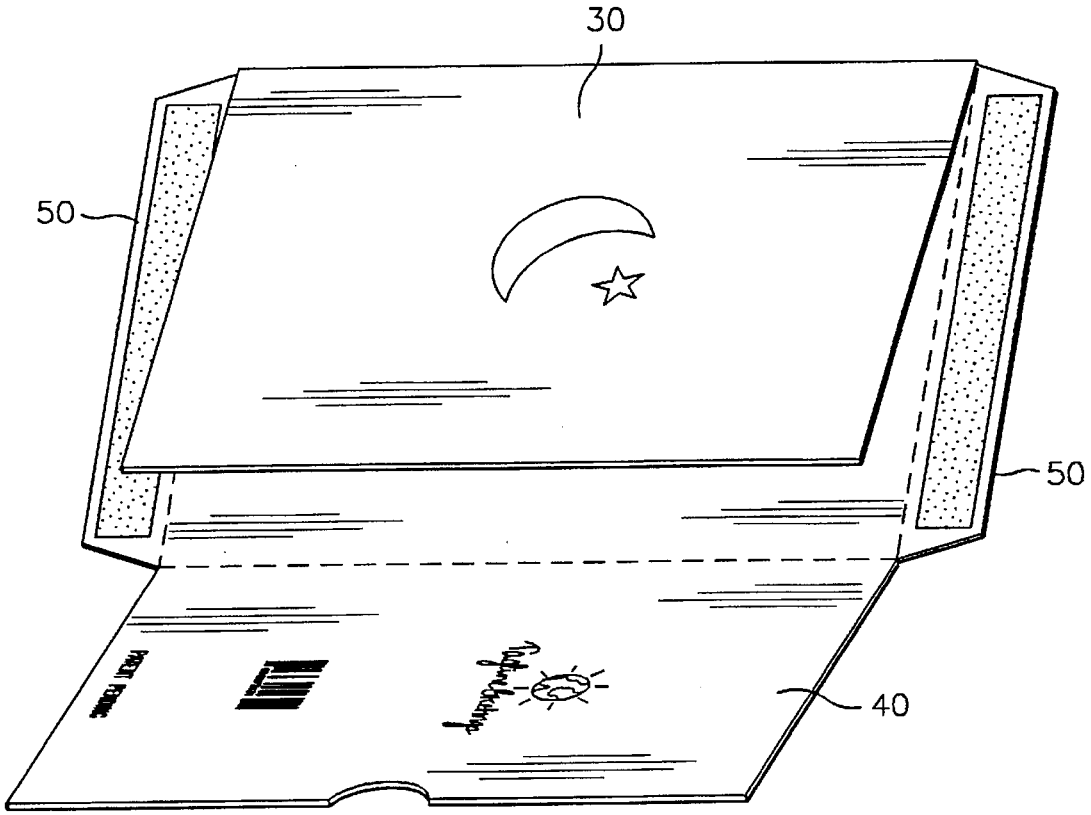
FIG. 7 shows a partial folding of the embodiment of FIG. 5.
Figure 8:
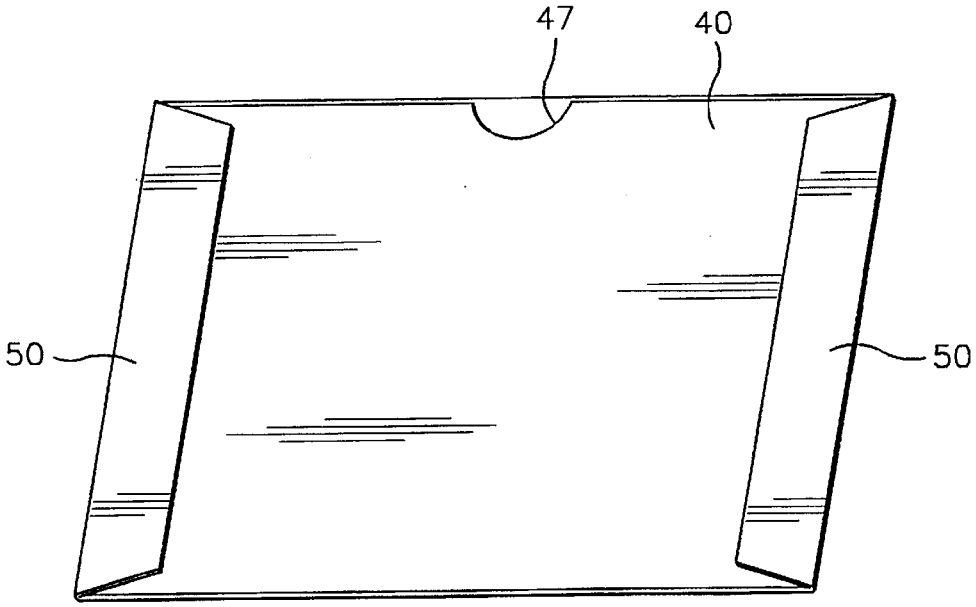
FIG. 8 shows a completed folding of the embodiment of FIG. 5.

Thus, to fold this embodiment of the envelope and greeting card combination 5 into a sealed, ready to be mailed configuration, the top panel 30 is first folded downwardly over the primary panel 20, as illustrated in FIG. 7. The bottom panel 40 is then folded upwardly and, when releasable adhesive layer 45 is included, the bottom panel 40 is releasably adhered to the reverse surface 14 of the top panel 30. The adhesive layer 55 on both the side panels 50 is then exposed or otherwise activated, and the side panels 50 are folded over the bottom panel 40 and permanently adhered to it. The device is thus secured in the folded configuration, illustrated in FIG. 8, and is ready to be mailed.

To open the sealed combination, the bottom panel 40 is simply grasped at the gripping means 47 and pulled upwardly away from the primary panel 20. This causes the side panels 50 to tear away from the primary panel 20 along the means for separation 16 and releases the card combination from the folded configuration. It is a key feature of this embodiment that the permanent adhesive layer 55 on the side panels 50 has a holding strength greater than that of the separation means 16 so that when the bottom panel 40 is pulled upwardly, the side panels 50 remain adhered to the bottom panel 40. This saves the user the step of having to manually tear away each of the side panels 50 after opening the card combination.

To open the sealed combination, the bottom panel 40 is simply grasped at the gripping means 47 and pulled upwardly away from the primary panel 20. This causes the side panels 50 to tear away from the primary panel 20 along the means for separation 16 and releases the card combination from the folded configuration. It is a key feature of this embodiment that the permanent adhesive layer 55 on the side panels 50 has a holding strength greater than that of the separation means 16 so that when the bottom panel 40 is pulled upwardly, the side panels 50 remain adhered to the bottom panel 40. This saves the user the step of having to manually tear away each of the side panels 50 after opening the card combination.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination envelope and greeting card comprising:

a primary rectangular panel, and a pair of side, a top, and a bottom ancillary panels foldably joined adjacently, contiguously, and separately, to the primary panel;

the primary panel providing, an obverse surface for placement of a greeting message, and a reverse surface providing indicia for guiding placement of an addressee address, a return address and for postage;

the top ancillary panel providing a reverse surface for placement of a greeting introduction indicia;

the bottom ancillary panel providing an obverse surface so that with the top panel folded into contact with the obverse surface of the primary panel, the obverse surface of the bottom panel is positionable against the reverse surface of the top panel;

one of the side panels providing a permanent adhesive layer on the obverse side thereof, such that with the other of the side panels folded into contact with the reverse sides of the top and bottom panels, the adhesive layer is adherable to the combination thereby securing the combination in a folded state for mailing;

the one side panel further including a pair of opposing and laterally extending tabs in positions for folding into contact with the reverse side of the primary panel for adhesive contact to secure the folded combination for mailing;

the one side panel further including a means for tearing the one side panel to enable unfolding of the combination;

the top, the bottom and the side panels each being attached to the primary panel by a perforated line such that the top, bottom and side panels may be torn-off of the primary panel after unfolding the combination;

the bottom panel, on the obverse side thereof, including a bottom panel adhesive layer adapted for temporary adherence, for removably fixing the bottom panel to the reverse side of the top panel when folded thereagainst, the bottom panel further including a curved edge cutout means for gripping an edge of the bottom panel for peeling the bottom panel away from the top panel when opening the combination.

* * * * *